US008471671B2

(12) United States Patent
Spalding et al.

(10) Patent No.: US 8,471,671 B2
(45) Date of Patent: Jun. 25, 2013

(54) FUSE AND ARC RESISTANT END CAP ASSEMBLY THEREFOR

(75) Inventors: Keith Allen Spalding, Fenton, MO (US); Varinder Kumar Kalra, Fort Meyers, FL (US)

(73) Assignee: Cooper Technologies Company, Houston, TX (US)

( * ) Notice: Subject to any disclaimer, the term of this patent is extended or adjusted under 35 U.S.C. 154(b) by 97 days.

(21) Appl. No.: 12/884,357

(22) Filed: Sep. 17, 2010

(65) Prior Publication Data

US 2012/0068810 A1 Mar. 22, 2012

(51) Int. Cl.
*H01H 85/165* (2006.01)

(52) U.S. Cl.
USPC ..... 337/248; 337/251; 337/279

(58) Field of Classification Search
USPC ..... 337/248, 251, 279
See application file for complete search history.

(56) References Cited

U.S. PATENT DOCUMENTS

| | | | | | |
|---|---|---|---|---|---|
| 2,734,112 | A | * | 2/1956 | Kozacka | 337/158 |
| 2,781,434 | A | * | 2/1957 | Swain | 337/159 |
| 2,953,665 | A | * | 9/1960 | Cox | 337/248 |
| 3,143,615 | A | * | 8/1964 | Kozacka | 337/163 |
| 3,179,774 | A | * | 4/1965 | Swain | 337/244 |
| 3,927,929 | A | * | 12/1975 | Puetz | 439/831 |
| 3,960,435 | A | * | 6/1976 | Bailey et al. | 439/831 |
| 4,205,294 | A | | 5/1980 | Jacobs, Jr. | |
| 4,344,058 | A | | 8/1982 | Knapp, Jr. et al. | |
| 4,413,246 | A | * | 11/1983 | Westrom et al. | 337/159 |
| 4,540,969 | A | | 9/1985 | Sugar | |
| 4,636,765 | A | * | 1/1987 | Krueger | 337/273 |
| 4,761,148 | A | * | 8/1988 | Sappington | 439/620.26 |
| 4,846,738 | A | * | 7/1989 | Herbert | 439/831 |
| 4,929,921 | A | | 5/1990 | Kalra et al. | |
| 5,018,991 | A | | 5/1991 | Katz et al. | |
| 5,367,281 | A | | 11/1994 | Crooks | |
| 5,701,118 | A | | 12/1997 | Hull et al. | |
| 5,812,046 | A | * | 9/1998 | Brown et al. | 337/290 |
| 5,892,427 | A | * | 4/1999 | Handcock | 337/229 |
| 6,147,585 | A | * | 11/2000 | Kalra et al. | 337/248 |
| 7,119,651 | B2 | * | 10/2006 | Darr et al. | 337/243 |
| 2005/0168315 | A1 | * | 8/2005 | Brown et al. | 337/248 |
| 2008/0169271 | A1 | | 7/2008 | Moore | |

FOREIGN PATENT DOCUMENTS

| | | | | |
|---|---|---|---|---|
| GB | 2163912 | A | * | 3/1986 |
| JP | 04048529 | A | * | 2/1992 |

* cited by examiner

*Primary Examiner* — Anatoly Vortman
(74) *Attorney, Agent, or Firm* — Armstrong Teasdale LLP

(57) ABSTRACT

Overcurrent protection fuses with end cap assemblies amenable to automated manufacturing techniques and providing arc burn through resistance when the fusible element opens therein. The end cap assemblies may include washers having arc resistant compositions and may include single or double end cap constructions. Fuse rejection features may be formed in one of the end caps and may create an empty space in the end cap when assembled to a fuse body.

12 Claims, 1 Drawing Sheet

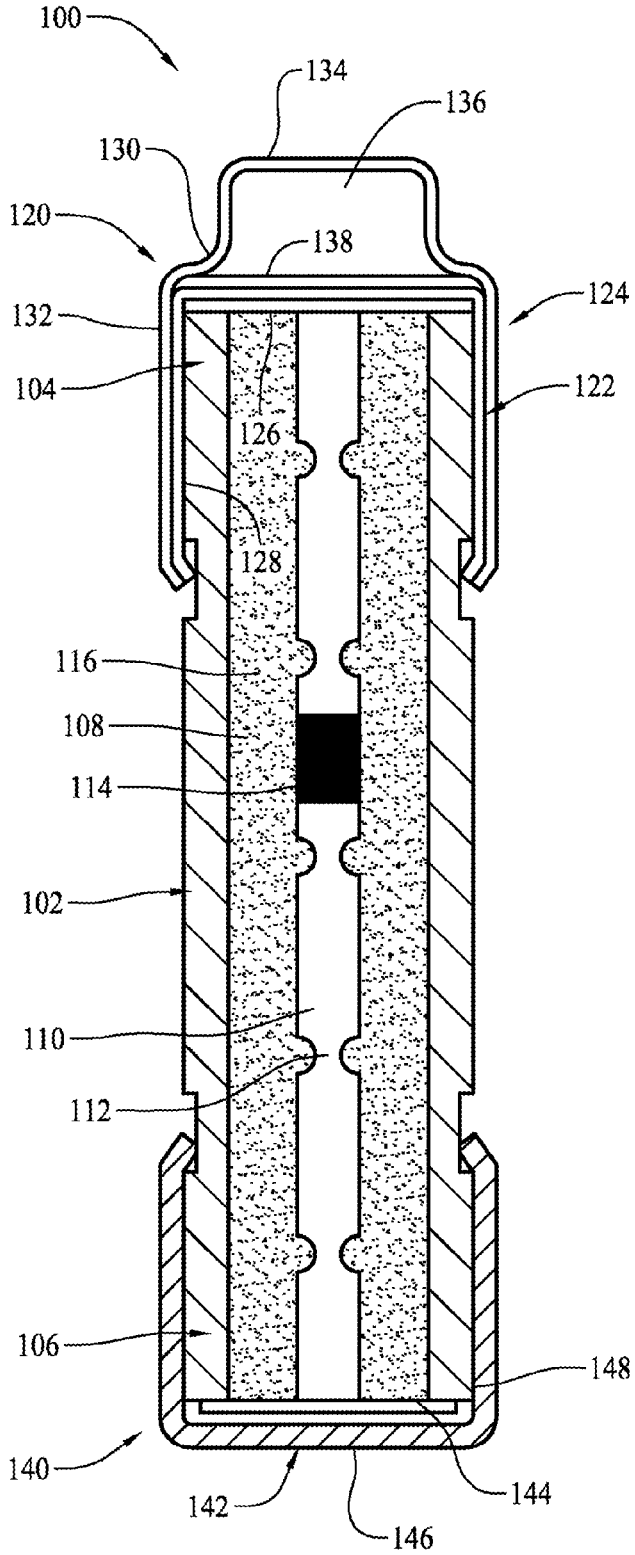
100
134
136
130
120
138
124
132
104
122
126
128
116
108
114
102
110
112
106
148
140
142
144
146

FUSE AND ARC RESISTANT END CAP ASSEMBLY THEREFOR

BACKGROUND OF THE INVENTION

The field of the invention relates generally to electrical fuse construction and manufacturing methods, and more specifically to overcurrent protection fuses having end cap assemblies with improved arc resistant capabilities.

Fuses are widely used as overcurrent protection devices to prevent costly damage to electrical circuits. Conductive fuse terminals typically form an electrical connection between an electrical power source and an electrical component or a combination of components arranged in an electrical circuit. One or more fusible links or fusible elements, or a fuse element assembly, is connected between the fuse terminals and defines a conductive path (or paths) between the fuse terminals. When the fuse terminals are connected to line and load side circuitry, and when electrical current flowing through the fusible element or fuse elements exceeds a predetermined limit, the fusible element(s) melt and open the current path between the fuse terminals, and open one or more circuits connected through the fuse. Load side circuitry is therefore electrically isolated from line side circuitry to prevent damage to load side electrical components and circuitry.

While a variety of different types of fuses are known, they are subject to certain performance limitations and manufacturing difficulties. Improvements are desired.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

FIG. 1 is a longitudinal cross sectional view of an exemplary embodiment of an overcurrent protection fuse.

DETAILED DESCRIPTION OF THE INVENTION

A variety of different types of fusible links are fusible elements are known for constructing overcurent protection fuses. Likewise, a variety of different types of fuse terminals are known for establishing electrical connections to external circuitry. The fuse terminals are typically coupled to a nonconductive fuse body, and the fusible links or elements extend interior to the body. The fusible link or elements define one or more conductive paths, sometimes referred to as a circuit paths, between the terminals.

Electrical arcing conditions may occur as the fusible links or fusible elements operate to open the current paths and isolate the load side electrical circuitry from the line side electrical circuitry in response to predetermined overcurrent conditions. Typically, an arc extinguishing media is provided in the fuse body and surrounds the fuse element. The arc extinguishing material is usually effective to absorb the arc energy safely within the interior of the fuse body, but when arcing conditions occur proximate to the terminals of the fuse, the terminals may be insufficient to contain arc energy and may rupture. This is undesirable from a number of perspectives, and thus manufacturers of certain types of fuses take special precautions to prevent the fuse terminals from being compromised in arcing conditions.

Some known types of fuses utilize terminals in the form of relatively thin walled terminal members known as end caps. It has been observed that electrical arcing conditions can sometimes burn through such thin walled terminals. To address such issues, brass washers are sometimes soldered to an interior of the end caps to provide additional burn through resistance to electrical arcing conditions. While this can be effective from a performance perspective, it is not entirely satisfactory form a manufacturing perspective. Specifically, the installation of the brass washers is difficult to automate in a reliable and cost effective manner.

Other types of fuses are known having a double end cap structure. In such fuses, a first or outer end cap is installed over a second or inner end cap. The outer and inner end caps are typically each thin walled conductive members. Nonconductive fiber material, sometimes referred to as greyboard, is sometimes placed between the facing end walls of the end caps. The fiber material may provide additional burn through protection in the event of electrical arcing conditions as the fuse operates. That is, the fiber material provides additional insulation to ensure that electrical arcing does not burn through and rupture the outer end cap. While effective to some extent in preventing electrical arcs from burning through the outer end cap, the fiber material has not proven to be a completely satisfactory solution to fuse manufacturers.

Some types of fuses include terminals in the form of conductive ferrules having reject features that prevent mismatching of fuses with fuseholders of different, and incompatible, ratings. Such rejection features can be implemented in various ways, some of which result in an inner space or cavity in the ferrule. In these types of fuses, the inner space in the ferrule is typically filled with solder as the fuses are manufactured. This results in extra manufacturing steps and a significant increase in the amount of solder needed to manufacture the fuses. Simplified fuse constructions and lower manufacturing costs are desired.

An exemplary embodiment of an overcurrent protection fuse 100 is shown in FIG. 1 in a longitudinal cross sectional view. As explained below, the fuse 100 advantageously overcomes the problems and disadvantages discussed above. Specifically, the fuse 100 is amenable to automated manufacturing processes in a relatively low cost manner while providing improved performance attributes and reliability. Method aspects will be in part apparent and in part specifically discussed in the following description.

The fuse 100 in the example shown may be recognized by those in the art as a cartridge fuse, although other configurations of the fuse 100 are possible. The fuse 100 is provided for purposes of illustration rather than limitation, and the concepts described herein may be embodied in a variety of fuses.

The fuse 100 generally includes a nonconductive fuse body 102 having opposed first and second ends 104 and 106. The body 102 in the example shown is cylindrical or tubular and is hollow between the first and second ends 104 and 106. The hollow body 102 in the exemplary embodiment defines a cylindrical through-hole or bore 108 extending through the body 102 from the end 104 to the end 106. While in the embodiment shown, the bore 108 has a substantially constant internal diameter, in another embodiment the internal diameter of the bore 108 may be tapered or otherwise non-uniform along the axial length of the fuse body 102 measured in a direction coincident to a centerline of the bore 108 in the example shown.

In the exemplary fuse 100 shown, the body 102 is round on its outer circumference and is shaped as an elongated cylinder. The bore 108 is accordingly round on its inner circumference and is shaped as an elongated cylindrical opening. This need not be the case in all embodiments, however. It is contemplated, for example, that the body 102 and/or the bore 108 could have a non-circular circumference, and may be square or rectangular for example in other embodiments. The body 102 may be fabricated from known materials in the art using known techniques.

A fusible element 110 is located within the fuse body 102 in the bore 108. The fusible element 110 in the embodiment depicted is a substantially flat and linearly extending element (i.e., extends in a straight line) formed from a planar strip of conductive material and including a plurality of areas 112 of reduced cross section, sometimes referred to as weak spots in the art. The fusible element 110 may also include a coating 114 on some or all of the element 110 which, in combination with the dimensions of the conductive element used to form the fusible element 110 and the dimensional aspects of the weak spot, can be strategically selected to ensure that the fusible element 110 disintegrates or otherwise structurally fails in response to a predetermined overcurrent condition. As the fusible element 110 fails, the conductive path or circuit path through the element 110 is opened or destroyed such that electrical current can no longer be conducted through it. The construction and operation of the fusible element 110 is well known and will not further be described herein. The fusible element 110 may be prefabricated using known techniques, and dropped into the fuse body 102 using an automated assembly process.

While an exemplary fusible element 110 is shown, it is understood that other configurations and types of fusible elements are also known and may likewise be utilized. For example, the fusible element 110 may include folds or bends such that it would not extend linearly in the fuse body 102. Moreover, wire fuse elements and the like are known and may be utilized in lieu of the fuse element strip 110 shown and described, although the strip 110 is perhaps advantageous as being more amenable to automation during manufacturing of the fuse 100. Wire fuse elements may be extended linearly or helically in the fuse body 102 as those in the art would no doubt appreciate. More than one fusible element 110 may also be provided in the fuse body 102.

The fuse element 110 may be surrounded in the bore 108 by arc extinguishing media 116, such as silica sand or another suitable material known in the art. Thus, if the fusible element 110 were to open at the location of one of the weak spots 112, for example, the arc extinguishing media 116 serves to suppress and extinguish electrical arcs. It is possible, however, that the fusible element 110 may open at a location proximate the ends of the fusible element 110 and electrical arcing accordingly may occur at the ends 104 and 106 of the body 102, and in such a case the arc extinguishing media 116 may not be effective to suppress or extinguish arcing conditions.

To address potentially problematic arcing conditions at the end 104 of the fuse body 102, an exemplary end cap assembly 120 is provided which effectively addresses the problems of conventional fuses, lowers the cost of manufacturing the fuse, and facilitates automation of fuse assembly.

In the exemplary embodiment shown, the end cap assembly 120 includes a first or inner end cap 122 and a second or outer end cap 124 secured to the body first end 104. Each end cap 122, 124 is fabricated as a generally thin walled conductive member utilizing known materials and formation techniques.

The inner end cap 122 includes a generally flat end wall 126 extending perpendicular to a longitudinal axis of the fuse body 102, and a cylindrical side wall 128. The cap 122 is fitted over the fuse body end 104 and is secured to the end 104 with a crimped connection as shown. The cap 122 need not be crimped, however, in other embodiments and may be mechanically attached to the body 102 by other means. The fusible element 110 may be mechanically and electrically connected to the end wall 126 via soldering techniques or other techniques known in the art to establish electrical connection between the inner end cap 122 and the fusible element 110.

The second or outer cap 124 in the exemplary embodiment shown includes an end wall 130 and a cylindrical side wall 132. The outer cap 124 is fitted over the end cap 122 and is secured thereto with a crimped connection in the embodiment shown, such that the side walls 132 and 128 of the end caps 122, 124 are in surface engagement and in mechanical and electrical contact with one another, thereby providing an electrical current path from the fusible element 110 through the side walls 128 and 132. Solder may optionally be provided between the side walls 128 and 132 for purposes of securing the caps 122 and 124 to one another and creating the electrical connections.

Unlike the end wall 126 of the inner end cap 122, the end wall 130 of the second end cap 124 is not flat. Rather, the end wall 130 is formed with an outwardly extending protrusion or projection 134 extending away from the end 104 of the fuse body 102. The projection 134 extends in a direction parallel to an axial length of the fuse 100 and serves as a fuse rejection feature that prevents the fuse 100 from being installed in certain types of incompatible fuse holders. While fuse rejection is beneficial and desirable to prevent mismatched fuses and fuseholders, it is contemplated that in some embodiments the fuse rejection feature could be considered optional and may not be provided.

When present, however, and as shown in the FIG. 1 the projection 134 formed in the end wall 130 of the outer end cap 124 creates an interior space 136 extending between the end wall 130 of the outer cap 124 and the end wall 126 of the inner cap 122. Unlike certain known types of fuses having fuse rejection features of this type, the interior space 136 is empty. That is, the interior space 136 is not filled with solder or any other substance. Considered across a large number of fuses 100, this results in a considerable decrease in solder needed to manufacture the fuses 100 in comparison to conventional fuses having fuse rejection features. Likewise, because the interior space 136 is empty and does not have to be filled, manufacturing processes are accordingly simplified in relation to known fuses and are more amenable to automation in a reliable and relatively low cost manner.

The end cap assembly 120, as also shown in FIG. 1, may include a nonconductive washer 138 interposed between the end wall 126 of the inner cap 122 and the end wall 130 of the outer cap 124. The washer 138 is a generally flat or planar, disk shaped element fabricated from an electrically nonconductive or insulating material in an exemplary embodiment. The washer 138 is solid or formed without openings therein, and generally occupies the entire outer diameter of the flat end wall 126 of the inner end cap 122, and also lies in surface contact with the end wall 126. The end wall 130 of the outer cap 124 encircles an outer periphery of the washer 138 and captures it in place, while the interior space 136 of the outer end cap 124 extends between the washer 138 and the projection 134 formed in the end wall 130. In the example shown in FIG. 1, the washer 138 extends entirely in the plane of the end wall 126 of the inner end cap 122, and does not extend along the sidewall 128 of the inner end cap 122.

In one embodiment, the washer 138 may be fabricated from a material having arc extinguishing properties. For example, the washer 138 may be fabricated from an arc extinguishing composition such as melamine and its related compounds. Other arc extinguishing compositions are known, however, and may be utilized. By using such a composition to fabricate the washer 138, if an arc were to burn through end wall 126 of the inner cap 122, it would reach the washer 138 and its arc extinguishing composition would operate to suppress and extinguish further arcing. Of even greater benefit, because the interior space 136 of the outer end cap 124 is empty, it may fill with arc extinguishing gas generated by the washer 138 and further ensure that arcing will not burn through the outer end cap 124. As such, an arc extinguishing washer 138 may provide substantial performance benefits in a relatively simple and straightforward construction that is amenable to automated processes. Also, a relatively small amount of arc extinguishing composition is needed to fabricate the relatively small washer 138.

In other embodiments, the washer 138 need not have arc extinguishing properties, but rather may be a nonconductive insulator such as the fiber greyboard material mentioned above that has been used in certain types of conventional fuses. Of course, other suitable nonconductive materials aside from fiber material could be utilized to fabricate the washer 138. For example, silicone washers and the like could be utilized in some embodiments.

In still further embodiments, the washer 138 need not be nonconductive, and instead may be a conductive element such as a brass or steel washer. As discussed above, however, a need to solder a conductive washer to one of the end caps may render this undesirable from a manufacturing perspective.

A second end cap assembly 140 is provided at the second end 106 of the fuse body 102. The second end cap assembly in the illustrated embodiment includes a single conductive end cap 142 and a washer 144. The end cap 142 has a relatively thick walled construction and includes a flat end wall 146 and a cylindrical side wall 148. The end cap 142 may be fitted over the second end 106 of the fuse body 102 and crimped in place. The washer 144 may be a flat, disk-shaped element fabricated from a conductive material, and a facing end of the fusible element 110 may be soldered or otherwise mechanically and electrically connected to the washer 144 or the end wall 146 of the cap 142. The washer 144 may be in surface engagement with the end wall 146 of the end cap 142 and provide a conductive path to electrical circuitry.

Because the end cap 142 has a thicker wall construction than the end caps 122, 124 the assembly 140 has an adequate burn through resistance in the event that electrical arcing occurs at the end 106 of the fuse body 102 as the fusible element 110 opens. To further enhance arc burn through resistance, however, the washer 144 could be nonconductive, and may include an arc extinguishing composition as described above. In such an embodiment, the facing end of the fusible element 110 may pass through the washer 144 and directly connect to the end wall 146 of the end cap 142 via soldering, brazing or welding techniques.

In the embodiment shown, the end cap 142 does not include a fuse rejection feature. It is contemplated, however, that in another embodiment a fuse rejection feature could be formed in the end cap 142 instead of the end cap 124 described above, and the end cap 124 could accordingly be provided with a flat end wall that does not include the projection 134.

In another embodiment, the end cap assembly 140 may alternatively include inner and outer end caps such as those described in relation to the end cap assembly 120, but without the fuse rejection feature.

In still another embodiment the end cap assemblies on the ends 104 and 106 of the fuse body 102 could be substantially identical, as opposed to being different in the exemplary fuse 100 depicted. That is, neither of the end cap assemblies on the ends 104 and 106 of the fuse body 102 may include a fuse rejection feature. Other optional terminal features could be provided in such an embodiment, including but not limited to knife-blade terminal contacts and the like, which may be integrally formed in the end caps or separately provided and attached to the end caps.

The fuse element 110 may be extended through the bore 108 in a manner parallel to the longitudinal axis of the body 102, or at an angle to the longitudinal axis. Placing the fuse element 110 at an angle can effectively increase a longitudinal length of the fuse element and enhance operating characteristics of the fuse 100. As a further enhancement of this type, the fuse element may be wound, helically or otherwise about a nonconductive core element or a nonconductive bridge element to extend the effective length of the fuse element by an amount not possible simply by placing it an angle to the longitudinal axis of the fuse body 102. Time delay features and the like may also be incorporated. Further variations and adaptations are possible.

The benefits and advantages of the fuse 100 are now believed to have been amply illustrated in connection with the exemplary embodiments disclosed.

An exemplary embodiment of an overcurent protection fuse has been disclosed including: a nonconductive fuse body having opposed first and second ends; at least one fusible element located within the fuse body; a first conductive end cap coupled to the fuse body at the first end, the first end cap electrically connected to the at least one fusible element; and a second conductive end cap secured to the first end cap, wherein the second end cap defines a fuse rejection feature.

Optionally, the first end cap may include a first end wall and a first cylindrical side wall. The first end wall may be flat. The second end cap may include a second end wall and a second cylindrical side wall, with the first and second cylindrical side walls in surface engagement with one another. The fuse rejection feature may be formed in the second end wall of the second end cap, and include a projection extending away from the first end that creates an interior space between the first end wall and the second end wall. The interior space is empty.

An optional washer may be provided and may extend between the first end wall and the second end wall. The washer may be electrically nonconductive and may include an arc extinguishing composition such as melamine.

A third end cap may optionally be coupled to the fuse body at the second end of the fuse body, and the third end cap may be electrically connected to the at least one fuse element. The third end cap may not include a fuse rejection feature, and the fuse may be a cartridge fuse.

Another embodiment of an overcurent protection fuse has also been disclosed. The fuse includes: a nonconductive fuse body having opposed first and second ends; at least one fusible element located within the fuse body; a first conductive end cap coupled to the fuse body at the first end, the first end cap electrically connected to the at least one fusible element; and a second conductive end cap secured to the first end cap. Each of the first and second end caps includes an end wall, and a nonconductive washer extends between the end wall of the first end cap and the end wall of the second end cap, wherein the washer comprises an arc extinguishing composition.

Optionally, the second end cap defines a fuse rejection feature. The end wall of the second cap may define a fuse rejecting protrusion creating a clearance between the washer and the protrusion. The clearance may be empty. The end wall of the first end cap may be flat and the washer may be flat, with the washer in surface engagement with the end wall of the first end cap. Each of the first and second end caps may include a cylindrical side wall, with the cylindrical side walls in surface engagement with one another.

Still another embodiment of an overcurent protection fuse has been disclosed including: a nonconductive fuse body having opposed an end; at least one fusible element located within the fuse body; a first conductive end cap coupled to the fuse body at the end, the first conductive end cap electrically connected to the at least one fusible element and including an end wall; and a nonconductive washer extending parallel to and in surface engagement with the end wall, wherein the washer comprises an arc extinguishing composition.

The arc extinguishing composition may optionally include melamine. A second end cap may be secured to the first end cap, and the second end cap includes a fuse rejection projection. The projection may create an internal space between the first end cap and the second end cap, and the space may be empty.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An overcurent protection fuse comprising:

a nonconductive fuse body having opposed first and second ends;

at least one fusible element located within the fuse body;

a first conductive end cap coupled to the fuse body at the first end, the first end cap comprising a first end wall and a first cylindrical side wall, the first end wall being flat and the first conductive end cap being electrically connected to the at least one fusible element;

a second conductive end cap secured to the first end cap, wherein the second end cap defines a fuse rejection feature on an exterior of the second conductive end cap and an unfilled space on an interior of the second conductive end cap;

wherein the second end cap includes a second end wall and a second cylindrical side wall, the first and second cylindrical side walls in surface engagement with one another and the second end wall in fluid communication with the unfilled space;

wherein the fuse rejection feature is formed in and projects from the second end wall of the second end cap, the fuse rejection feature comprising a projection extending away from the first end wall, and the unfilled space extending between the first end wall and the second end wall; and a washer extending adjacent the first end wall;

wherein the washer is nonconductive and wherein the washer comprises an arc extinguishing composition, the washer being in fluid communication with the unfilled space, whereby when an electrical arc burns through the first conductive end cap as the at least one fuse element operates, arc extinguishing gas generated by the an arc extinguishing composition fills the unfilled space and prevents the arc from burning through the second conductive end cap.

2. The fuse of claim 1, wherein the arc extinguishing composition includes melamine.

3. The fuse of claim 1, further comprising at least a third end cap coupled to the fuse body at the second end of the fuse body, the third end cap electrically connected to the at least one fuse element.

4. The fuse of claim 3, wherein the third end cap does not include a fuse rejection feature.

5. The fuse of claim 1, wherein the fuse comprises a cartridge fuse.

6. An overcurrent protection fuse comprising:

a nonconductive fuse body having opposed first and second ends;

at least one fusible element located within the fuse body;

a first conductive end cap coupled to the fuse body at the first end, the first end cap electrically connected to the at least one fusible element; and a second conductive end cap secured to the first end cap, the second end cap defining an unfilled interior space extending from the first conductive end cap; and a nonconductive washer in communication with the unfilled interior space, the nonconductive washer comprising an arc extinguishing composition;

whereby when an electrical arc burns through the first conductive end cap as the at least one fuse element operates, arc extinguishing gas generated by the nonconductive washer fills the unfilled interior space and prevents the arc from burning through the second conductive end cap.

7. The fuse of claim 6, wherein the second end cap defines a fuse rejection feature.

8. The fuse of claim 6, wherein each of the first and second end caps includes a cylindrical side wall, the cylindrical side walls of the first and second end caps in surface engagement with one another.

9. The fuse of claim 6, wherein the arc extinguishing composition includes melamine.

10. An overcurent protection fuse comprising:

a nonconductive fuse body having opposed first and second ends;

at least one fusible element located within the fuse body;

a double end cap assembly coupled to the fuse body at the first end, the double end cap assembly comprising a first end cap electrically connected to the at least one fusible element and a second end cap coupled to the first end cap and defining an unfilled interior space; and a single end cap assembly coupled to the fuse body at the second end and electrically connected to the at least one fusible element wherein the double end cap assembly further comprises a washer, wherein the washer is in fluid communication with the unfilled interior space, and wherein the washer includes an arc extinguishing composition, whereby when an electrical arc burns through the first conductive end cap as the at least one fuse element operates, arc extinguishing gas generated by the nonconductive washer fills the unfilled interior space and prevents the arc from burning through the second end cap.

11. The fuse of claim 10, wherein the single end cap assembly further comprises a washer adjacent the second end of the nonconductive fuse body.

12. The fuse of claim 10 wherein the first and second end caps of the double end cap assembly have a thin walled construction, and wherein the single end cap assembly has a thick walled construction relative to the first and second end caps of the double end cap assembly.

* * * * *